US005426456A

United States Patent [19]

Kuelzer et al.

[11] Patent Number: 5,426,456

[45] Date of Patent: Jun. 20, 1995

[54] SUCTION AND COVERING DEVICE FOR SUCTIONING INK FROM INK PRINT HEADS OF AN INK JET PRINT UNIT AND FOR SEALING THE INK JET PRINT HEADS

[75] Inventors: Peter Kuelzer, Wessling/Hochstadt; Wilhelm Kirner, Anzing, both of Germany

[73] Assignee: Eastman Kodak Company, Rochester, N.Y.

[21] Appl. No.: 915,103

[22] Filed: Jul. 9, 1992

[30] Foreign Application Priority Data

Jan. 9, 1990 [EP] European Pat. Off. ..... 90100373

[51] Int. Cl.[6] ..... B41J 2/165

[52] U.S. Cl. ..... 347/30; 347/29

[58] Field of Search ..... 396/1.1, 75, 140 R; 347/22, 29, 30

[56] References Cited

U.S. PATENT DOCUMENTS

| | | | |
|---|---|---|---|
| 4,847,637 | 5/1988 | Okamura . | |
| 5,086,305 | 2/1992 | Terasawa | 346/140 R X |
| 5,146,243 | 9/1992 | English et al. | 346/140 R |
| 5,166,708 | 11/1992 | Hirano et al. | 346/140 R |

FOREIGN PATENT DOCUMENTS

| | | |
|---|---|---|
| 2589788 | 5/1987 | France . |
| 57-22066 | 2/1982 | Japan . |
| 60-162656 | 8/1985 | Japan . |
| 62-113559 | 5/1987 | Japan . |

*Primary Examiner*—Benjamin R. Fuller
*Assistant Examiner*—J. E. Barlow, Jr.
*Attorney, Agent, or Firm*—Horst M. Kasper

[57] ABSTRACT

The suction and covering device (4, 4*a*, 4*b*) described has flexible rubber insert caps (41, 41*a*) with a fluid-absorbing lining (42, 42*a*), for suctioning ink from the print heads (80) and for sealing the print heads hermetically. Each rubber insert cap (41, 41*a*) is associated with a duct (403, 415, 463) for pressure compensation in the rubber insert cap and with an aspiration duct (401, 400) for removing ink. In order to ensure controlled removal of ink from each rubber insert cap (41, 41*a*), each suction duct (401, 400) has a valve device (48, 420), wherein the valve device may be a slit-type valve or a capillary filter. A controllable closure or a diaphragm in the pressure-compensation duct prevents air from being forced into the jet nozzle apertures when coupling up.

21 Claims, 4 Drawing Sheets

SUCTION AND COVERING DEVICE FOR SUCTIONING INK FROM INK PRINT HEADS OF AN INK JET PRINT UNIT AND FOR SEALING THE INK JET PRINT HEADS

CROSS-REFERENCE TO RELATED APPLICATIONS

This application is a continuation-in-part application of international application Ser. No. 01/112,094 filed under the Patent Cooperation Treaty Dec. 4, 1990, bearing Application No. PCT/EP90/02094, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a suction and covering device for suctioning ink from ink jet print heads of an ink jet print unit and for sealing the print heads including elastic cups, pressure compensation channels, suction channels, and a valve device.

2. Brief Description of the Background of the Invention Including Prior Art

Ink jet printing devices are of increasing interest for the user based on the development of ever more powerful and increasingly higher capability microprocessors in addition to a plurality of other print devices such as, for example, pin printers, matrix printers, thermal transfer printers, thermal printers, thermographic printers, and electrophotographic printers. The purchase of a printer is frequently a complex decision, where the production features such as speed, economy and print quality are in the foreground based on the increased capability of the peripheral text processing apparatus. The production feature, namely to be able to print in color, is furthermore of marked importance for various fields of application. For this purpose, ink printing presents optimum preconditions and prerequisites based on the use of color writing liquids, which can be produced at a low cost and in a simple manner, in addition to the thermal transfer printing process.

The ink colors employed for providing color to the writing liquids are, for example, yellow, cyan, magenta, and black according to the German printed patent document DE-A1 37 36 916. The ink in the nozzle exit openings of an ink jet print head can dry up in case of longer printing intervals. In order to prevent this drying, the ink jet print device exhibits, for example, a cleaning and sealing station or, respectively, a suction regeneration device. Cleaning and sealing stations can also be employed to eliminate soiling at the nozzle exit openings of the ink jet print head in the ink jet print device. For this purpose, the ink jet print heads are cleaned at regular time intervals and are sealed in case of longer printing intervals of the ink jet printing device. The cleaning and sealing station exhibits for this purpose a suction and covering device.

If such suction and covering devices are employed in color printers, then the danger arises that ink fluids of different colors are mixed during cleaning and sealing in the area of the nozzle ejection openings and this results in interferences and disturbances of the print image, and this causes unnecessary downtimes of the print devices and requires additional cleaning processes.

In general, an ink meniscus at the nozzle ejection openings prevents entry and penetration of air into the ink supply region of the ink jet print heads in print devices, which operate according to the negative pressure principle. The suction and covering devices can destroy such block menisci by pressing air into the ink jet ejection openings. This requires additional ventilation procedures under certain circumstances.

A cleaning and sealing station or, respectively, a suction regeneration device for ink jet print heads in ink jet print devices is known in each case from the German printed patent document DE-A1-33 16 474, German printed patent document DE-A1-33 16 968, German printed patent document DE-A1-36 04 373, German printed patent document DE-A1-36 11 333, German printed patent document DE-A1-36 33 239, German printed patent document DE-A1-37 26 671, German printed patent document DE-A1-38 10 698, and European printed patent document EP-A1-0,094,220. Nozzle exit openings of the ink jet print heads are cleaned, flushed and the nozzle exit openings are sealed in case of longer printing intervals of the ink jet print devices in different ways with the cleaning and sealing station or, respectively, the suction regeneration device.

SUMMARY OF THE INVENTION

1. Purposes of the Invention

It is object of the present invention to construct a suction and covering device for the suctioning of ink from ink jet print heads of an ink jet printer and for covering the ink jet print heads such that the ink jet print heads can be reliably cleaned and sealed without interfering with the functional capabilities of the ink jet print heads.

It is a further object of the present invention to provide for a suction and covering device which avoids a pressing of air into the ink jet ejection openings of the ink jet print heads by the suction and covering device.

These and other objects and advantages of the present invention will become evident from the description which follows.

2. Brief Description of the Invention

The present invention provides for a suction and covering device for suctioning ink from an ink jet print head of an ink jet print unit and for covering the ink jet print head. An elastic rubber insert cap is provided to be resting at the ink jet print head. A pressure compensation channel is coordinated to and connected to the rubber insert cap for furnishing a pressure compensation in the rubber insert cap. A suction channel is coordinated to and connected to the rubber insert cap for allowing a withdrawal of ink. A pressure compensation device is coupled and connected to the pressure compensation channel of the rubber insert cap. A common withdrawal channel is connected to the suction channel. A suction device is connected to the common withdrawal channel. A valve device is disposed at the suction channel for assuring a controlled withdrawal of ink from the rubber insert cap.

A common ventilation channel can be disposed at and coupled to the pressure compensation channel. A controllable closure can be furnished at the common ventilation channel. The controllable closure can regulate a feeding of air as required depending on the operating position of the suction and covering device.

A common pressure compensation chamber can be provided for the pressure compensation channel. A compensation membrane can close the pressure compensation chamber relative to the ambient air. The common pressure compensation chamber and the compensation membrane can form a pressure compensation device as a closed system relative to the ambient air.

A capillary filter can be disposed in the suction channel and be associated with the valve device. A suction pressure acting at the withdrawal channel can be selected such that, upon emptying the suction channel, the capillary filter is only then overcome by the inflowing ambient air through the suction channel when the suction channel no longer contains any ink.

A sieve with capillary openings can be furnished at the capillary filter. A hydraulic throttle can be coordinated to and associated with the withdrawal channel. The hydraulic throttle can be dimensioned such that a pressure drop through the flowing ink in the throttle is such that relative to the applied suction pressure the difference pressure of the ink is smaller than the capillary blocking pressure at a border face air - sieve.

A one-way directional valve can be disposed in the valve device and coordinated to the suction channel. The one-way directional valve can open in a suction direction of the ink and can close in a direction opposite to the suction direction of the ink.

A liner of a fluid-absorbing material can be disposed in the rubber insert cap. The rubber insert cap can have a tub shape.

An elastically formed sealing lip can surround a tub-shaped floor of the rubber insert cap. The elastically formed sealing lip hermetically can seal the ink jet print head upon pressing-on of the rubber insert cap onto the ink jet print unit. A web can be included in the elastically formed sealing lip surrounding the tub floor of the rubber insert cap. The web can be constructed like lamellas based on cross ribs. The elastically formed sealing lip can limit a rubber insert cap opening. The elastically formed sealing lip can be disposed on the web. The elastically formed sealing lip can provide a lock stop for the fluid-absorbing liner. The elastically formed sealing lip can be constructed for securing the fluid-absorbing liner disposed in the rubber insert cap against falling out.

A burl-shaped extension can be disposed at the rubber insert cap. The burl-shaped extension can be disposed at a floor of the rubber insert cap. The burl-shaped extension can serve for an attachment of the rubber insert cap in a single form part. The burl-shaped extension can be disposed at the floor of the rubber insert cap for receiving one of the pressure compensation channel and the suction channel.

The burl-shaped extension can receive the suction channel. The burl-shaped extension can include a funnel-shaped port. The funnel-shaped port can rest in an assembled state of the rubber insert cap at the capillary filter.

A second elastic rubber insert cap can be provided to be resting at a second ink jet print head, wherein the number of rubber insert caps corresponds to the number of ink jet print heads. A second pressure compensation channel can be coordinated to and connected to the second rubber insert cap for furnishing a pressure compensation in the second rubber insert cap. The pressure compensation device can be coupled and connected to the second pressure compensation channel of the second rubber insert cap. A second suction channel can be coordinated to and connected to the second rubber insert cap for allowing a withdrawal of ink. The common withdrawal channel can be connected to the suction channel.

A second liner of a fluid-absorbing material can be disposed in the second rubber insert cap. The second rubber insert cap can have a tub shape. A second elastically formed sealing lip can surround a second tub-shaped floor of the second rubber insert cap. The second elastically formed sealing lip hermetically can seal the second ink jet print head upon pressing-on of the second rubber insert cap onto the ink jet print unit. A second web can be included in the second elastically formed sealing lip surrounding the second tub floor of the second rubber insert cap. The second web can be constructed like lamellas based on cross ribs. The second elastically formed sealing lip can limit a rubber insert cap opening. The second sealing lip can be disposed on the second web. The second elastically formed sealing lip can provide a second lock stop for the second fluid-absorbing liner. The second elastically formed sealing lip can be constructed for securing the second fluid-absorbing liner disposed in the second rubber insert cap against falling out. A second burl-shaped extension can be disposed at the second rubber insert cap. The second burl-shaped extension can be disposed at a second floor of the second rubber insert cap. The second burl-shaped extension can serve for an attachment of the second rubber insert cap in the single form part. The second burl-shaped extension, disposed at the floor of the rubber insert cap, can receive one of the pressure compensation channel and the suction channel.

The second burl-shaped extension can receive the suction channel. The second burl-shaped extension can include a second funnel-shaped port. The second funnel-shaped port can rest in an assembled state of the second rubber insert cap at the capillary filter.

A method of a covering and suctioning of an ink jet print unit comprises the following steps. A cleaning and sealing station is positioned into an overshoot region of an ink jet print head. An elastic rubber insert cap, attached to the cleaning and sealing station, is pressed against the face of the ink jet print head such that an ink jet nozzle of the ink jet print head is completely covered. A pressure compensation is furnished in the rubber insert cap through a pressure compensation channel, coordinated and connected to the rubber insert cap. Ink is withdrawn through a suction channel coordinated to and connected to the rubber insert cap. The pressure in the pressure compensation channel is set with a pressure compensation device, coupled and connected to the pressure compensation channel of the rubber insert cap. The ink is suctioned through the suction channel and through a common withdrawal channel connected to the suction channel. The withdrawal of ink from the rubber insert cap is regulated with a valve device disposed in the suction channel.

A feeding of air into a common ventilation channel disposed at and coupled to the pressure compensation channel can be regulated, depending on the operating position of the suction and cover device. The pressure compensation chamber relative to the ambient air can be closed via a compensation membrane. The suction pressure acting on the withdrawal channel can be selected such that, upon emptying of the suction channel, the capillary filter is only then overcome by the inflowing ambient air through the suction channel, when the suction channel no longer contains any ink. A pressure in the flowing ink can be dropped by a hydraulic throttle disposed in the withdrawal channel such that a pressure drop through the flowing ink in the throttle is such that, relative to the applied suction pressure, the difference pressure of the ink is smaller than the capillary blocking pressure at the border face air - sieve.

Ink jet print heads with several rows of nozzles can be reliably and leak-free flushed and covered with the suction and covering device constructed according to the invention.

The disposition of a valve device in the suction channel allows a controlled removal of the ink from each suction cap of the suction and covering device without that there occurs a mixing of the ink suctioned from the different rows of nozzles. This is in particular of an advantage where the ink jet print head is constructed as a multicolor ink print head, wherein each row of nozzles is coordinated to a writing fluid of different color.

No air can penetrate into the rows of nozzles during the docking and thereby interfere with the functioning of the ink jet print head.

A fluid-absorbing liner placed into the suction caps takes care during covering that a sufficiently humid ambient condition is present in the area of the nozzle ejection opening and thereby prevents a drying of the ink.

A capillary filter, coordinated to the suction channels of the suction caps, allows a complete emptying of the suction caps during a rest state of the cleaning and sealing station without any residual ink remaining in one of the caps.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawing, in which are shown several of the various possible embodiments of the present invention.

DESCRIPTION OF INVENTION AND PREFERRED EMBODIMENT

Figure 1:
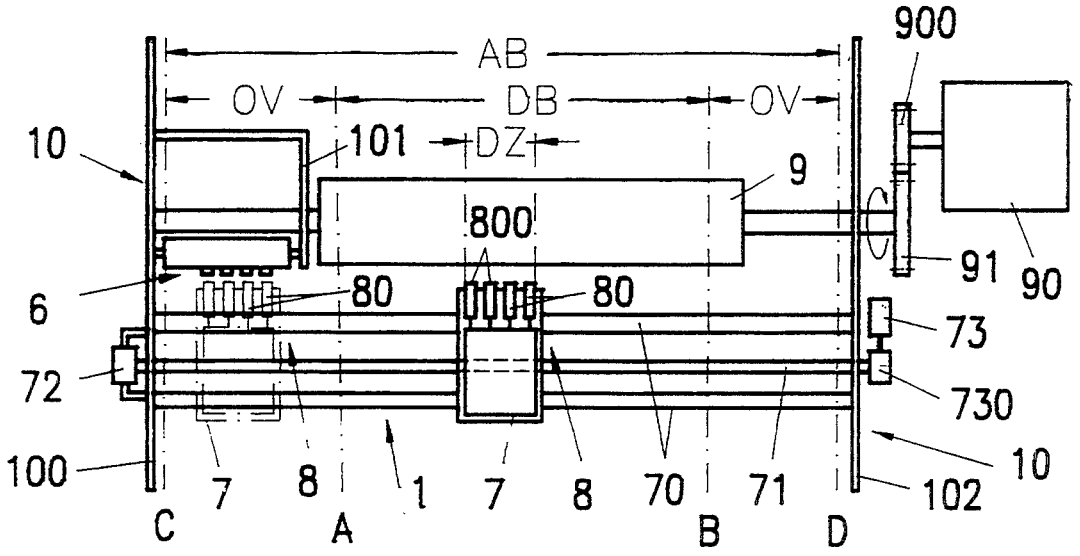
FIG. 1 is a top plan view onto an ink jet print device.

According to the present invention, there is provided for a suction and covering device for suctioning ink from ink jet print heads 80 of an ink jet print device 1 and for covering the ink jet print heads 80. Elastic rubber insert caps 41, 41*a* are provided at the ink jet print heads 80. The number of rubber insert caps 41, 41*a* corresponds to the number of ink jet print heads 80. A pressure compensation channel 403, 415, 463 is coordinated to each of the rubber insert caps 41, 41*a* for a pressure compensation in the rubber insert caps and a suction channel 401, 400 is coordinated to each of the rubber insert caps for the withdrawal of the ink. The pressure compensation channels 403, 415, 463 of the rubber insert caps 41, 41*a* are coupled to a pressure compensation device 43, 55, 403*a*, 423. The suction channels 401, 400 join in a common withdrawal channel 49, 470, where the common withdrawal channel 49, 470 is in connection with a suction device 51. A valve device 48, 420 is coordinated to each suction channel 401, 400 for a controlled withdrawal of ink from each cap 41, 41*a*.

The pressure compensation device can exhibit a common ventilation channel 465, 430, coupled with the pressure compensation channels. The common ventilation channel can have a controllable closure 55 for the feeding of air as required depending on the operating position of the suction and covering device. The pressure compensation device can be formed as a closed system relative to the ambient air, with a common pressure compensation chamber 403*a* for the pressure compensation channels 403, 465 and a compensation membrane 423, closing the pressure compensation chamber 403*a* relative to the ambient air. The valve device 48, 420, coordinated to the suction channels 401, 400, can exhibit a capillary filter 48 disposed in the suction channels 401, 400. A suction pressure acting at the withdrawal channel 49, 470 can be selected such that, upon emptying the suction channels, the capillary filter 48 can only then be overcome by the inflowing ambient air through the suction channels 400, 401 when all suction channels no longer contain any ink. The capillary filter can exhibit a sieve 48 with capillary openings and a hydraulic throttle 450 can be coordinated to the withdrawal channel 470, 49. The hydraulic throttle can be dimensioned such that the pressure drop through the flowing ink in the throttle is at least so large that the difference pressure relative to the applied suction pressure is smaller than the capillary blocking pressure at the border face air - sieve.

The valve device coordinated to the suction channels 400, 401 can exhibit a one-way directional valve 420, opening in suction direction of the ink and closing in opposite direction to the suction direction of the ink. The rubber insert cap 41, 41*a* can exhibit a liner 42, 42*a* of a fluid-absorbing material. The rubber insert caps 41, 41*a* can be of a tub shape.

The rubber insert caps 41, 41*a* can include elastically formed sealing lips 410, 414, 410*a* surrounding the tub floor 412, 412*a*. Said lips can hermetically seal the ink jet print heads 80 upon pressing-on of the rubber insert cap 41, 41*a* to the ink jet print unit 8. The elastically formed sealing lip 410, 414 surrounding the tub floor 412 of each rubber insert cap 41 can include a web 414 constructed like lamellas based on cross ribs 413. The elastically formed sealing lip 410 limiting a cap opening 411 can be disposed on the web 414. The elastically formed sealing lip 410 can be constructed such that a fluid-absorbing liner 42, 42*a*, disposed in each rubber insert cap 41 can be secured against falling out. The rubber insert caps 41, 41*a* can exhibit burl-shaped extensions 418 disposed at the rubber insert cap floors 412, 412*a*, which can be furnished for the attachment of the rubber insert caps 41 in a single form part 46, 47. The burl-shaped extensions 418, disposed at the rubber insert cap floors 412, 412*a*, can receive the pressure compensation channel and/or the suction channel.

The burl-shaped extension 418 receiving the suction channel can exhibit a funnel-shaped port 417. The funnel-shaped port 417 can rest in an assembled state of the rubber insert cap 41 at the capillary filter 48.

FIG. 1 illustrates in a top plan view onto a construction in principle of an ink jet print device 1. It is a characteristic feature of the construction of the ink jet print device 1 that an ink jet print unit 8 is disposed on a printer carriage 7. The ink jet print unit 8 can be moved parallel to a print counter support formed by a roller platen 9 rotatably supported in two casing walls 100 and 102 of a support frame 10. The roller platen 9 is driven by a drive device 90 with a first drive pinion 900 via a gear train 91 in the illustrated direction of rotation. The roller platen 9 transports a sheet-shaped recording substrate into a print zone PZ, formed by the ink print unit 8 and the roller platen 9, where the recording substrate extends for example over a print region PR. In order to be able to print onto the recording substrate and assuming the ink jet print device 1 is constructed as a four-color printer, the ink jet print unit 8 in the present case exhibits side-be-side disposed ink jet print heads 80 with nozzle ejection faces 800 disposed toward the recording substrate. The four available color print fluids are the colors yellow, magenta, cyan and black. The colored print fluids can thereby be arbitrarily coordinated to the four different ink jet print heads 80. It is recommended, however, based on purposes associated with the cleaning of the ink jet print heads 80, that the colors be coordinated in the recited sequence to the ink jet print heads 80 from the right to the left.

The region of the sheet-shaped recording substrate, disposed opposite to the ink jet print heads 80, is designated as print zone PZ. In order to be able to print onto the sheet-shaped recording substrate over the complete width of the print region PR, the printer carriage 7 is moved back and forth on two parallel disposed guide rods 70 attached in the casing walls 100, 102. The back and forth movement of the printer carriage 7 is performed, as described in the German Utility Patent document DE-GM 89 06727, based on a flexible pulling means and traction mechanism 71, which wraps shape-matchingly around a deflection roller 72 and a second drive pinion 730 of an electromotor 73.

The printer carriage 7 with the ink jet print unit 8 is moved back and forth between the positions delimiting the print region PR for printing onto the recording substrate guided by the roller platen 9 into the print region PR. In this context, both a one-directional printing operation as well as bidirectional printing operation are possible as mode of operation. In case of the one-directional printing operation, the recording substrate is imprinted line by line only in one direction of motion. In case of a bidirectional printing operation, which allows a substantially higher printing speed, the recording substrate is imprinted line by line in the print region PR in both directions of motion of the ink jet print unit 8 including the ink jet print head.

Independent of the mode of operation, the printer carriage 7, disposed in a rest position "C" outside of the print region PR, is initially accelerated up to the position "A" upon print start, such that the printer carriage 7 achieves the speed required for the continuous printing relative to the recording substrate. The position "A" defines the first possible print position. Subsequently, the printer carriage 7 is moved with constant speed for the printing in the actual print region PR until it reaches the position "B". The position "B" determines the last possible print position of the print region PR. After surpassing the position "B", the printer carriage 7 is braked up to the position "D", representing a right end position of the printer carriage, and is brought to rest, and then the recording substrate is advanced further by a printing line with the roller platen 7. For printing the following line, the printer carriage is accelerated in an opposite direction from the position "D" into the position "B", which position "B" now determines the first print position of the following line to be printed. After reaching the print speed in the position "B", the following line can then be printed between the positions "B" and "A". When the printer carriage 7 reaches the last possible print position "A", then the printer carriage 7 is again braked up to the position "C", representing a left end position of the printer carriage. Thus, the positions "C" and "D" represent outermost positions of the printer carriage. The positions "A" and "B" represent the left and right extreme printing positions of the carriage and the distance difference of position "B" minus position "A" represents the printing width of the printer. At the point "C", a renewed line advance with renewed line printing is performed. Line by line of the recording substrate is now printed in the described fashion.

In the one-directional printing operation, it is advantageous to move the printer carriage in a quick return from the position "B" into the position "C".

The path distances "C" - "A" and "B" - "D" are designated in the following as overshoot regions OV. The two overshoot regions OV together with the print region PR determine an operating region or work region OP for the ink jet print unit 8. The minimum length is determined by the physically required acceleration distance and braking distance under consideration of the mechanical tolerances. The embodiment described in connection with FIG. 1 has an overshoot region OV of a length of about 40 millimeters.

Soiling at the ink jet print heads 80 can occur during the printing operation based on paper dust. Therefore, the ink jet print heads 80 have to be cleaned from time to time. The ink jet print heads 80 are thereby flushed such that the ink is suctioned out of the ink jet print heads 80 via the nozzle ejection openings. The flushing of the ink jet heads 80 also prevents simultaneously that the ink dries at the nozzle ejection openings of the ink jet print heads 80, which were not used during the writing operation. For this purpose, a cleaning and sealing station 6 is furnished in the ink jet print device 1. The cleaning and sealing station 6 is disposed in an overshoot region OV of the printer carriage 7. This can be both a left-side as well as a right-side overshoot region OV. The left-side overshoot region has proven to be advantageous for positioning a cleaning and sealing station 6.

The printer carriage 7 is moved up to the left rest stop at the casing wall 100 of the support frame 10 in the overshoot region OV for the cleaning of the ink jet print heads 80. The casing wall 100 thereby forms a common reference edge for the cleaning and sealing station 6 and for the printer carriage 7, where the reference edge is of importance for defining the cleaning process. By way of the description of FIGS. 2 through 10, it is illustrated how the cleaning process is performed in detail.

Figure 2:
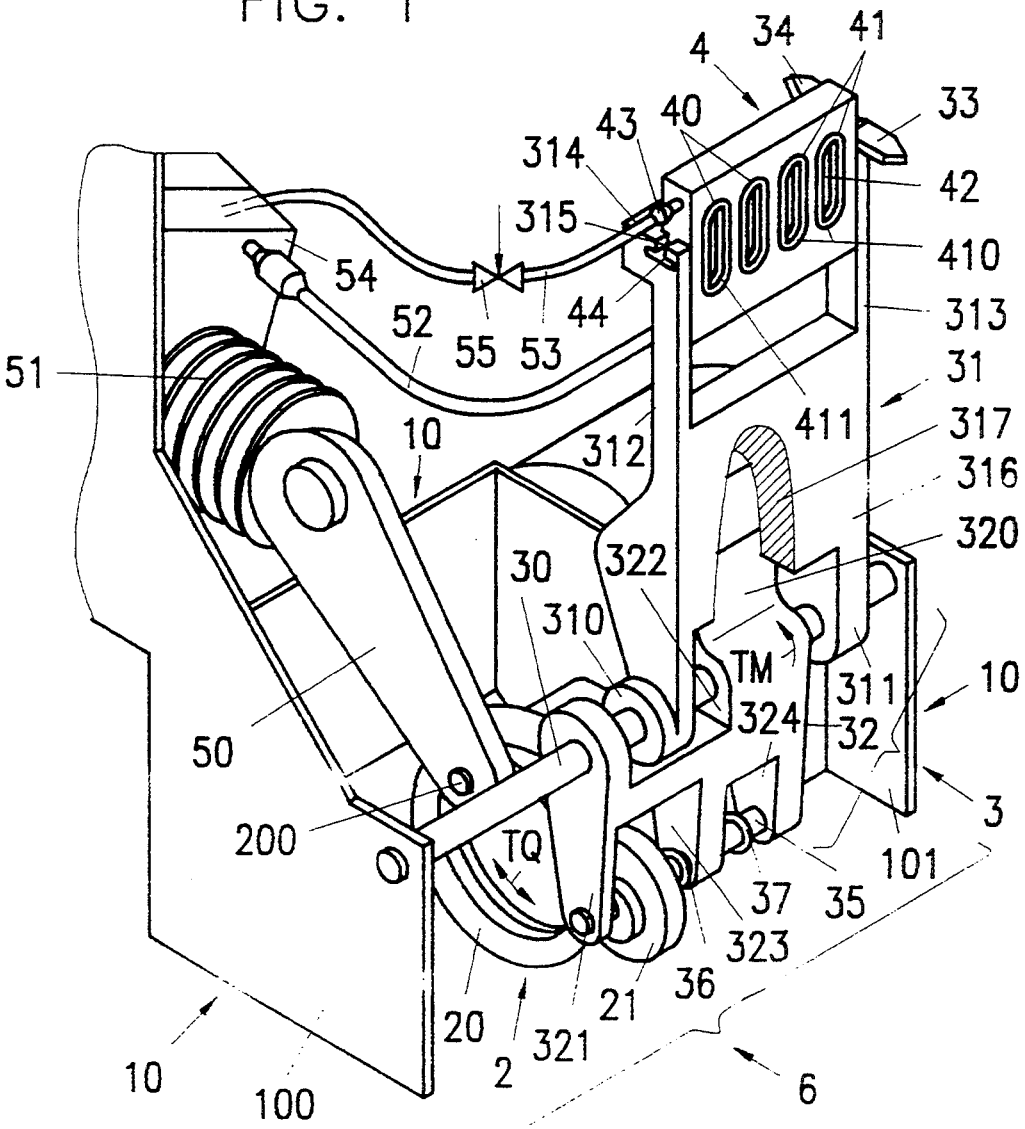
FIG. 2 is a perspective view of a cleaning and sealing station.

FIG. 2 shows a perspective representation of the construction of the cleaning and sealing station 6, designated in the following as cleaning and sealing CS station 6. The cleaning and sealing CS station 6 is thereby constructed as an autonomous and self-contained construction unit operating independently of the ink jet print device 1. The cleaning and sealing CS station 6 can be employed as a closed, independent and separately exchangeable construction unit in the ink jet print device. This is associated with the advantage that the cleaning and sealing CS station 6 can be employed as an original equipment manufacturing OEM product in various ink jet print devices. Various servicing treatments of the ink jet print heads 80 are performed with the cleaning and sealing station 6, where the servicing treatments are necessary for an interference-free operation of the ink jet print device 1. These servicing treatments comprise amongst others: the cleaning of the ink jet print head 80 with its nozzle ejection openings at predetermined time intervals in order to prevent thereby a drying and soiling of the nozzle ejection openings; the suctioning of ink contained in the ink jet print head 80 in case of interferences, for example, in order to remove air which has entered; and the covering of the nozzle ejection openings in a rest state of the ink jet print device 1, in order to protect the nozzle ejection openings from drying and soiling, for example, by a dust deposit of a paper dust. Furthermore, the ink jet print device 1 has to be prevented from leaking ink out of the nozzle ejection openings during transportation and storage.

Since the cleaning and sealing CS station 6 is disposed within the overshoot region OV for the printer carriage 7 supporting the ink Jet print unit 8 in the ink jet print device 1 and resulting from the writing operation of the ink jet print device 1 according to FIG. 1, there results a narrower construction of the ink jet print device 1 as compared to a situation, where a separate space would be required for the sealing and cleaning station 6 in the longitudinal direction of the platen 9.

The cleaning and sealing CS station 6 cannot be allowed to block the overshoot region OV of the printer carriage 7 between the position "A" and the position "C" according to FIG. 1 during print operation, when the printer carriage 7 is temporarily present in the overshoot region OV based on acceleration and braking processes.

During servicing operation, when the nozzle ejection openings of the ink jet print unit 8 are to be cleaned, the cleaning and sealing CS station 6 has to be docked at a precise position at the ink jet print unit 8 and the ink is suctioned from the nozzle ejection openings. The term "docking" refers in this context to the coupling of the cleaning and sealing CS station 6 to the ink jet print unit 8.

The nozzle ejection openings have to be protected from drying in the rest position, during transport and during the storing of the ink jet print device 1. Furthermore, no ink can be allowed to flow out. Therefore, it is necessary that the cleaning and sealing CS station 6 is docked at a precise position at the ink jet print unit 8 and that the nozzle exit openings are thereby closed.

The cleaning and sealing CS station 6 includes a switch coupling 2, a swivel lever 3, a suction and cover cap 4, as well as a bellows pump 5. The switch coupling 2 exhibits a cam disk 20 and a running wheel 21, where the running wheel 21 rolls off on the cam disk 20. For receiving a torque TQ, the cam disk 20 is attached in a shape matching way on a drive shaft of a further electromotor, not illustrated in FIG. 2. Preferably a DC motor is employed as an electromotor.

Furthermore the cam disk 20 exhibits a protrudingly and eccentrically disposed crank pin 200 on the front face side disposed away from the electromotor. The crank pin 200 is connected via a linkage 50 with a bellows 51 of the bellows pump 5. The bellows 51 are alternately pulled apart or, respectively, pressed together via the linkage 50 based on the rotation of the cam disk 20 with the eccentrically disposed crank pin 200. The thereby generated pump action of the bellows pump 5 is employed in the present cleaning and sealing CS station 6, for example, in order to pump the ink out of the nozzle ejection openings of the ink jet print heads 80 in FIG. 1. The bellows pump 5 is connected both through a hose 52 as well as through an air hose 53 to the suction and cover SC cap 4. It is however also possible to suction and to discharge other fluids from various injection spray devices with the cleaning and sealing CS station 6.

Four equally sized, identically shaped recesses 40, formed as suction openings or hollow spaces, are disposed in the suction and cover SC cap 4 for pumping the ink from the ink jet print heads 80 of the ink jet print device 1. These recesses 40 are either connected via the hose 52, providing a suction channel to a discharge container 54, attached at the bellows pump 5, or the recesses 40 are connected via the air hose 53, providing a pressure compensation channel to the ambient air. The air hose 53 exhibits a controllable ventilation valve 55, coupled for example with the bellows pump 5. For this purpose the air hose 53 is put over and attached to a ventilation port 43, wherein the ventilation port 43 protrudes on the side out of the suction and cover SC cap 4. The ink can also be suctioned with a hose pump, a piston pump, or a membrane pump out of the nozzle ejection openings as an alternative to the bellows pump 5.

The number of the recesses 40, which are contained in the suction and cover SC cap 4 of the cleaning and sealing CS station 6 depends on the number of ink jet print heads employed. If, as in the instant case, for example a multicolored print image is to be produced with the ink jet print device 1, then the servicing treatment of the ink jet print device 1 has also to be designed for the discharging of the required four ink jet print heads. In order to avoid a mixing of the writing fluids during the suctioning from the nozzle ejection openings of the ink jet print heads, the number of the recesses 40 or, respectively, of the suction openings is identical to the number of the colored writing fluids employed and coordinated to the ink jet print heads.

In each case, a tub-shaped rubber insert 41 in the shape of an elastic rubber insert cap is disposed in the suction openings 40 on the side of the suction and cover SC cap 4, disposed toward the ink jet print unit 8. This rubber insert cap 41 supports a liquid-absorbing liner 42.

The suction and cover SC cap 4, as already mentioned, is docked onto the ink jet print unit 8 for pumping the ink from the ink jet print heads 80, wherein the elastic caps 41 are put over the nozzle ejection openings of the ink jet print heads for covering the nozzle ejection openings. If mention is made in the following of docking the suction and cover SC cap 4, then this is intended to refer to a lateral shifting and tilting of the cap 4. A sealing lip 410 is disposed on the tub-shaped rubber insert cap 41 such that the ink can be pumped without difficulty through the suction openings 40 as well as through the hose 52. The sealing lip surrounds a tub opening 411 of the rubber insert cap 41 and is pressed against the ink jet print unit 8 during the docking of the suction and cover SC cap 4 and whereby the nozzle ejection openings of the ink jet print heads 80 are hermetically sealed.

The docking of the suction and cover SC cap 4 is effected by the swivel lever 3. The swivel lever 3 is shiftably and pivotably supported on a first axle 30 clamped between the casing wall 100 and a further casing wall 101 of the support frame 10. The frictional influences have to be kept as small as possible in order to be able to perform the shifting and pivoting of the swivel lever 3 with a minimal force expenditure.

The swivel process is triggered by transforming the torque TQ, delivered by the electromotor, through the switch coupling 2 into a tilting moment TM acting and engaging at the swivel lever 3. The swivel lever 3 is spring supported and tensioned via the running wheel 21 at the cam disk 20 for the transformation of the torque TQ. The swivel lever 3 is constructed of two parts, thereby subdividing the dead weight of the swivel lever 3, co-responsible for the frictional influences, in order to maintain the forces small which occur during the spring tensioning. The two-part construction of the swivel lever 3, however, is explained substantially in that a lateral shifting of the swivel lever 3 can be required for a position-precise docking of the suction and cover SC cap 4. In case of a one-piece construction, this would result in a shifting of the running wheel 21 on the cam disk 20. The running surface for the running wheel 21 on the cam disk 20 would have to be designed for a maximum possible lateral shifting during the docking in case of a one-piece construction.

An upper lever part 31 of the swivel lever 3 supporting the suction and cover SC cap 4 is disposed on the axle 30, tiltable and shiftable via two swivel arms 310, 311. The upper lever part 31 of the swivel lever 3 exhibits furthermore two oppositely disposed support arms 312, 313. The support arms 312, 313 are connected to each other on the side remote relative to the ink jet print unit 8 through a U-shaped cross bracing 314. According to a first embodiment, in each case a T-shaped recess 315 is inserted and trimmed in the arms of the U-shaped cross-bracing 314 for the support of the suction and cover SC cap 4. This T-shaped recess serves for the freely movable support of bearing pins 44 of the suction and cover SC cap 4. The bearing pins 44 are pressed into the T-shaped recess 315 for supporting the suction and cover SC cap 4. The upper lever part 31 exhibits in addition a rectangular center part 316, between the swivel arms 310, 311 and the support arms 312, 313, wherein a pocket-shaped recess 317 is set into the lever upper part 31.

A positioning device is furnished for docking the suction and cover SC cap 4 with a precise position at the ink jet print unit 8. The positioning device comprises two opposingly disposed centering fingers 33, wherein the centering fingers 33 end in an acute angle in the swivel direction of the swivel lever 3. The centering fingers 33 are disposed on the side of the support arm 313 on the arm of the U-shaped cross-bracing 314. A first centering finger 33 locates for this purpose during the swivelling of the swivel lever 3 automatically a centering window 81 (FIG. 3) formed in the ink jet print unit 8 but not illustrated in FIG. 2 and positions thus the cleaning and sealing CS station 6 opposite to the ink jet print unit 8. The lever 3 can be shifted sideways with the cleaning and sealing CS station 6 for positioning purposes.

The tilting moment TM is transferred onto the upper lever part 31 of the swivel lever 3 through a lower lever part 32 of the swivel lever 3 for purposes of docking the suction and cover SC cap 4. The lower lever part 32 is disposed pivotably on the axle 30 for this purpose just as is the lever upper part 31. A characteristic feature of the lower lever part 32 are a lever arm 320 and a side arm 321, where the axle 30 is inserted through the lever arm 320 and the side arm 321 centered or, respectively, at the end point. A first recess 322 is furnished between the lever arm 320 and the side arm 321 in the region of the axle 30, where the swivel arm 310 of the upper lever part 31 is disposed. The dimensions of the recess 322 are selected in this context such that the upper lever part 31 can be shifted sideways depending on need independently of the lower lever part 32. In addition, a second recess 323 is furnished between the lever arm 320 and the side arm 321, where the running wheel 21 is axially movable and rotatably supported on a second axle 35 in the second recess 323. Furthermore, a first spring 36 is disposed on the axle 35 within the recess 323, wherein the first spring 36 opposes the axial movability of the running wheel 21 with a first spring force F1. The axle 35 additionally grips through a third recess 324, wherein the third recess 324 is set into the foot point of the lever arm 320. A second spring 37 of a spring force F2 is hung at the axle 35 within this third recess 324, wherein the second spring 37 is in addition also connected with the support frame 10 of the ink jet print device 1 for the swivelling process of the swivel lever 3. However, this feature is not visibly illustrated in FIG. 1.

The running wheel 21 is pressed against the cam disk 20 by the second spring force F2 of the spring 37. The swivel motion of the swivel lever 3, required for the docking of the suction and cover SC cap 4, is transferred from the lever arm 320 of the lower lever part 32 onto the upper lever part 31. The lever arm 320 engages for this purpose sliding block-like with a small play in swivel direction of the swivel lever 3 into the pocket-shaped recess 317 of the upper lever part 31 between the swivel arms 310, 311. In order to be able to shift the upper lever part 31 on the axle 30, the pocket-shaped recess 317 of the upper lever part 31 is wider relative to the lever arm 320 of the lower lever part 32 by a such amount, which is required for a lateral shifting of the upper lever part 31 and thus of the suction and cover SC cap 4 for allowing a shifting of the lever upper part 31 on the axle 30.

Figure 3:
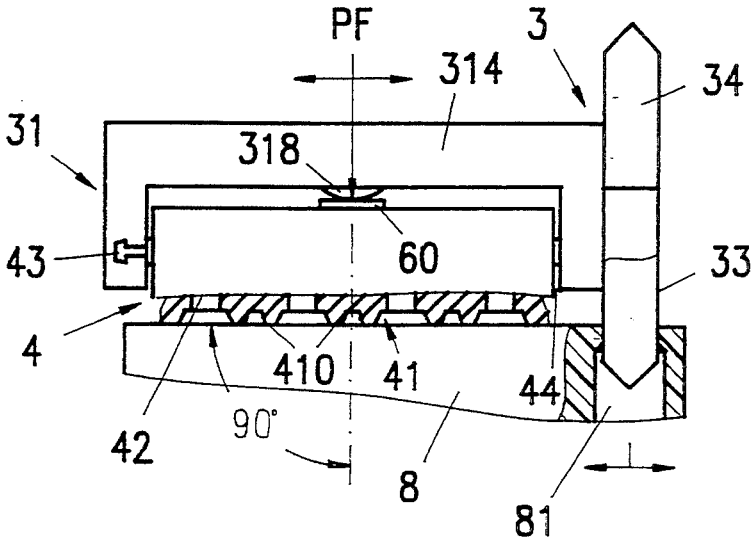
FIG. 3 is a top plan view onto a suction and cover cap supported on a swivel lever of a cleaning and sealing station.

FIG. 3 illustrates in a top plan view the swivelling support of the suction and cover SC cap 4 docked at a precise position at the ink jet print unit 8 in the swivel lever 3. The first centering finger 33 is inserted into the centering window 81 of the ink jet print unit 8 for the position precise docking of the suction and cover SC cap 4 and the first centering finger 33 aligns thus both the swivel lever 3 as well as the suction and cover SC cap 4 relative to the ink jet print unit 8 in a lateral direction. The autonomous alignment of the suction and cover SC cap 4 independent of the swivel process of the swivel lever 3 is made possible, on the one hand, in that the suction and cover SC cap 4 is supported tiltable and freely movable in the upper lever part and, on the other hand, in that a press-on force PF required for the docking is transferred centrally and uniformly through the U-shaped cross bracing 314. The U-shaped cross bracing 314 exhibits for this purpose a spherical segment 318 directed toward the center of gravity of the suction and cover SC cap 4, and the press-on force PF is transferred onto the suction and cover SC cap 4 through the spherical segment 318. A press-on plate 60, disposed on the back side of the suction and cover SC cap 4, rests at the spherical segment 318. The suction and cover SC cap 4, which is supported freely movable and swivelled at a right angle relative to the ink jet print unit 8, is also aligned at a right angle relative to the ink jet print unit 8. The press-on force PF corresponds to the amount of the spring force F2 and engages at the swivel lever 3 in a direction opposite to the spring force F2.

Figure 4:
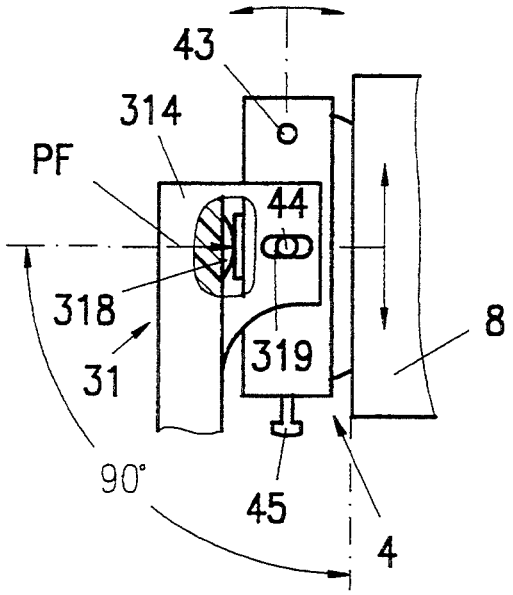
FIG. 4 is a side elevational view of a suction and cover cap supported on a swivel lever of a cleaning and sealing station related to a detail visible in the upper right part of FIG. 2.

FIG. 4 illustrates in a side elevational view how the suction and cover SC cap 4 is supported in the upper lever part 31 of the swivel lever 3. An elongated hole 319 is disposed in the legs of the U-shaped cross bracing 314 according to a second embodiment for the support of the suction and cover SC cap 4, wherein the bearing pins 44 of the suction and cover SC cap 4 are freely movably supported in the elongated hole 319 in the direction of the press-on force PF. The elongated hole 319 is offered for the reason that the position of the suction and cover SC cap 4 relative to the ink jet print unit 8 is not critical in a direction orthogonal to the direction of the press-on force PF for the docking of the suction and cover SC cap 4 at the ink jet print unit 8.

In contradistinction to the first embodiment for the support of the suction and cover SC cap 4, where the suction and cover SC cap 4 is pressed into the T-shaped recess 315, the support arms 312, 313 for the second embodiment have to be pressed apart from each other in order to support the suction and cover SC cap 4 in the swivel lever 3. As a result, the swivel lever 3 is also preferably produced of a plastic material in addition to the suction and cover SC cap 4 and the switch coupling 2. According to the first embodiment of the support of the suction and cover SC cap 4, it would however also be possible to form all the recited elements of the cleaning and sealing CS station 6 of metallic material.

FIG. 4 illustrates further a suction port 45 for the hose 52 at the lower side of the suction and cover SC cap 4, where the ink suctioned from the nozzle ejection openings is transferred into the discharge container 54 through the suction port 45.

Figure 5:
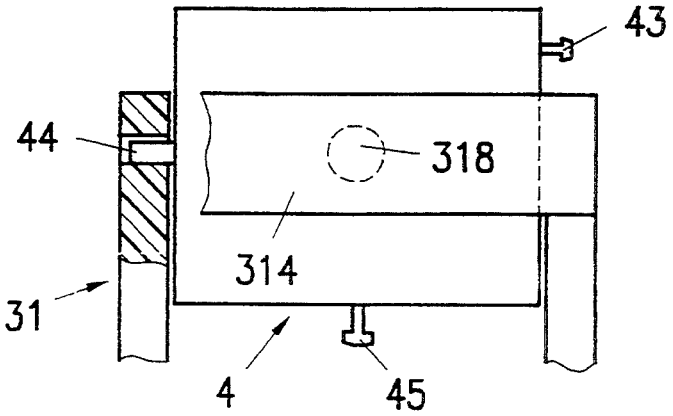
FIG. 5 is a rear elevational view of a suction and cover cap disposed on a swivel lever of the cleaning and sealing station related to a detail corresponding to a rear view of the upper right part of FIG. 2.

FIG. 5 illustrates how the spherical segment 318 is disposed on the inner face of the U-shaped cross bracing 314 and how the suction port 45 is disposed relative to the lower side of the suction and cover SC cap 4 in a rear view of the suction and cover SC cap 4, supported tiltably and freely movable in the swivel lever 3.

Figure 6:
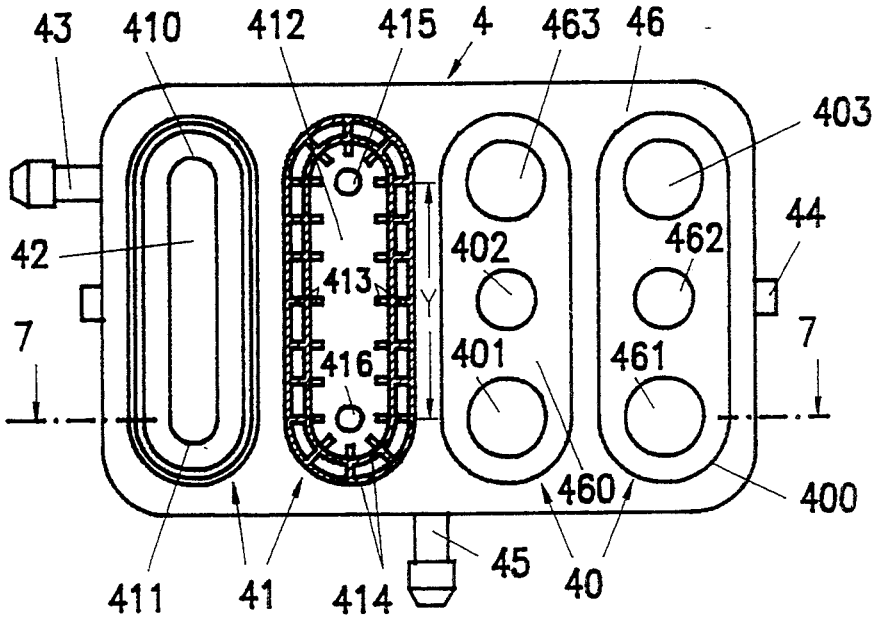
FIG. 6 is a front elevational view onto a first embodiment of a suction and cover cap.

The detailed construction of a first embodiment of the suction and cover SC cap 4 with the four suction openings 40, furnishing hollow spaces for the separate suctioning of the ink from the nozzle ejection openings of the ink jet print heads 80 is shown in FIG. 6 in a top plan view. The rubber insert cap 41 is inserted into two of the suction openings 40 and, in addition, one of the rubber insert caps 41 is cut open in longitudinal direction in order to illustrate both the recess configuration of the suction openings 40, furnishing hollow spaces as well as the construction of the rubber insert cap 41 in FIG. 6.

The suction and cover SC cap 4 exhibits a rectangular, for example in the corners rounded support part 46, where the recess 40 of the suction openings both in the length as well as in the width are inserted uniformly distributed into the support part 46. Each of the suction openings 40 comprises a pressure compensation channel (403, 463) for pressure compensation and a suction channel (461, 401) for the discharging of the suctioned ink as well as a centrally disposed opening 462 for the attachment of the tub-shaped rubber insert cap 41, 41*a*. The suction recess 40 exhibits preferably an oval-shaped first chamber 400 for receiving of the tub-shaped rubber insert cap 41, 41*a*. The tub-shaped rubber insert cap 41 can be inserted in this oval chamber 400 and can be attached at the opening 462. The pressure compensation channel comprises a connection opening 463 with an associated chamber 402, and the suction channel comprises a second connection opening 461 with an associated second chamber 401.

The first chamber 400 can also be formed rectangular with slightly rounded corners instead of an oval shape. However, it has to be assured in this context that the rubber insert cap 41 can still be disposed shape-matching in the first chamber 400.

The rubber insert cap 41 with the sealing lip 410, surrounding the tub opening 411, and the liner 42 disposed in the rubber insert cap 41 has the purpose to seal the nozzle ejection openings of the ink jet print head 80 during the docking of the suction and cover SC cap 4 at the ink jet print unit 8 such that, during the suctioning of the ink, the ink cannot escape at the docking position between the sealing lip 410 and the nozzle ejection face 800 of the ink jet print unit 8. Since the ink is suctioned from the nozzle ejection openings of the ink jet print heads 80 with the aid of a negative pressure, the rubber insert cap 41 on the one hand has to exhibit a certain elasticity for the suctioning of the ink and, on the other hand, has to exhibit a certain stiffness for the docking of the suction and cover SC cap 4. A suitable compromise between the elasticity and the stiffness of the rubber insert cap 41 is achieved by providing that tub-shaped rubber insert cap 41 according to FIG. 6 includes a tub floor 412, forming the tub shape, with a web 414 formed as a hollow profile with cross ribs 413 and surrounding and edging the tub floor 412. The cross ribs 413 are disposed in the web 414, furnished as a hollow profile, such that a lamella-like structure is generated. On the other hand, the cross ribs 413 protrude as small protrusions on the tub floor 412 into the tub-shaped rubber insert cap 41. It is thereby achieved that the liner 42 does not rest immediately on the tub floor 412 of the rubber insert cap 41. Furthermore, two passage openings 415, 416, disposed at a distance y relative to each other, are inserted into the tub floor 412 on the longitudinal axis of the tub floor 412. The tub generally has an elongated shape formed by two semicircles at the ends of the elongation direction joined by a rectangular section having a width corresponding to the widths of the semicircles and having a length from about 1.5 to 5 times the diameter of the semicircles and preferably from about 2 to 3 times the diameter of the semicircles, where the rectangular section is disposed in the middle between the semicircles. The distance y corresponds preferably to ⅔ of the total length of the longitudinal axis of the tub floor 412. A first passage opening 415 of the rubber insert cap 41, inserted into the hollow space 40, joins thereby into the pressure compensation channel 403, where the pressure compensation channel 403 is connected to the ventilation port 43. A second passage opening 416 of the rubber insert cap 41 joins into the suction channel 401, where the suction channel 401 is connected to the suction port 45.

Figure 7:
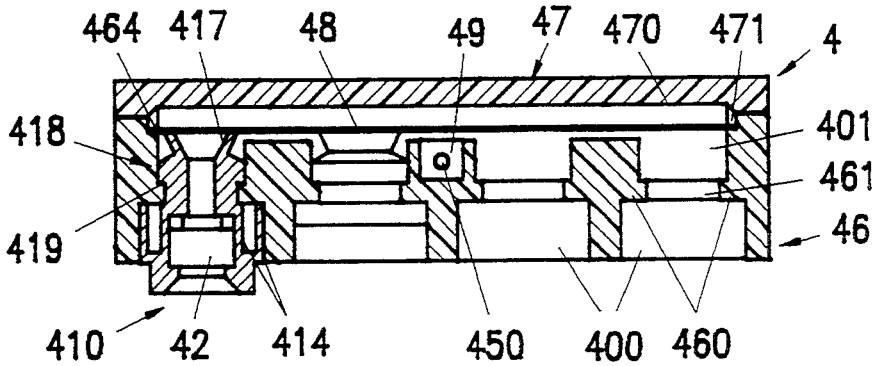
FIG. 7 is a horizontal cross-sectional view of the suction and cover cap according to FIG. 6 alog a section line 7—7.

FIG. 7 illustrates a cross-section through the suction and cover SC cap 4 according to FIG. 6 along a section line 7—7. The support part 46 of the suction and cover SC cap 4 is covered on the back side with a cover plate 47, where the cover plate 47 closes the chambers 401, 402, 403. The cover plate 47 and the support plate 46 form a single form part. The cover plate 47 exhibits a recess 470 along the section line 7—7, which recess 470 is covered with an oval-shaped sieve 48. The sieve 48 is disposed shape-matchingly in a recess 464 of the support part 46, and is pressed by a protrusion 471 of the cover plate 47 during the assembly of the suction and cover SC cap 44 against the support part 46. The cover plate 47 is for example welded to the support part 46 during the mounting of the suction and cover SC cap 4. However, it is also possible to connect the cover plate 47 detachably with the support part 46. It has only to be assured in this context that no ink can escape from the suction and cover SC cap 4. The recess 470 together with the chambers 401 of the suction channels of the recesses 40 and the sieve 48 forms a common withdrawal channel which exhibits the suction port 45 as an outlet. The sieve 48 serves during the insertion of the rubber insert cap 41 into the hollow space 40 as a stop for a funnel-shaped port or mouth 417, wherein the funnel-shaped port or mouth 417 is disposed at a burl-shaped extension 418 of the tub floor 412 in the region of the second passage opening 416. The passage opening 416 is extended up to the sieve 48 based on the burl-shaped extension 418 and the funnel-shaped port or mouth 417. The diameter of the funnel-shaped port or mouth 417 at its widest open diameter can be from about 0.5 to 1.0 times the diameter of the liner 42. The diameter of the funnel-shaped port or mouth 417 can be at its narrowest open diameter from about 0.1 to 0.5, and preferably from about 0.2 to 0.4, of the diameter of the liner. The total length of the rubber insert cap 41 in flow direction can be from about 1 to 5 times the width of the liner 42 and is preferably from about 1.5 to 3 times the width of the liner 42.

The burl-shaped extension 418 exhibits a flange-like shaped projection 419 for the insertion of the rubber insert cap 41 into the hollow space 40, wherein the flange-like shaped projection 419 grips behind the separating wall 460 through a first bore hole 461 during the plugging through of the burl-shaped extension 418. The diameter of the flange-like shaped projection 419 can be from about 1.05 to 1.3, and is preferably from about 1.1 to 1.2, times the diameter of the rubber insert section at a section neighboring in front of the flange-like shaped projection. The total length of the burl-shaped extension 418 and of the funnel-shaped port 417 is dimensioned such that the suctioned ink jet fluid, passing through the passage opening 416, passes from the nozzle ejection openings only in the region of the funnel-shaped port 417 via the sieve 48 into the recess 470.

Two additional burl-shaped extensions 418 with the flange-like shaped projection 419 are disposed in the region of the first passage opening 415 and in the center of the tub floor 412 below the tub floor 412, wherein the flange-like shaped projection 419 grips also behind the separating wall 460 upon plugging through the burl-shaped extension 418 through a second bore 462 or, respectively, through a third bore 463. The burl-shaped extension 418 is formed in the region of the first passage opening 415 such that the passage opening 415 joins into the fourth chamber 403. The rubber insert cap 41 is attached uniformly in the support part 46 by the burl-shaped extension 418 in the center of the tub floor 412. This is associated with the advantage that the rubber insert cap 41, docked at the ink jet print unit 8, is not lifted out from the first chamber 400 upon suctioning the ink in the region between the two passage openings 415, 416.

The different color ink fluids passing in this way from the suction and cover SC cap 4 via the rubber insert caps 41, disposed in the hollow spaces 40, into the recess 470 are suctioned via the sieve 48 and a catch basin 49, disposed in the support part 46, through a discharge port 450 of the discharge port 45 into the discharge container 54, wherein the discharge port 450 joins into the catch basin 49. The catch basin 49 is preferably disposed in the center of the support part 46 between two neighboring chambers 401 of the suction channels of the recesses 40. A penetration of ink or, respectively, ink mixtures into neighboring suction channels or, respectively, the recesses 40 of the suction channels is prevented by the funnel-shaped ports 417, resting at the sieve filter 48, during the suctioning of the ink through the suction channels and the recess 470.

Figure 8:
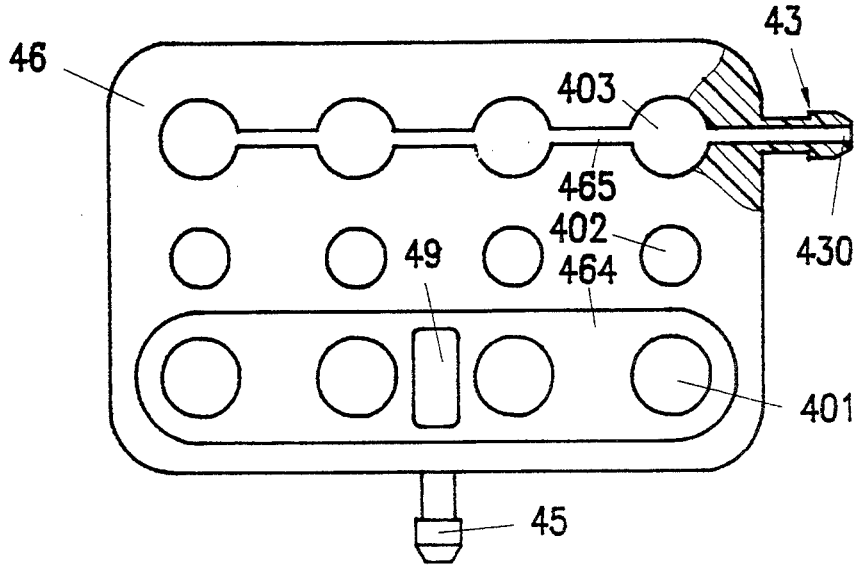
FIG. 8 is a rear elevational view of a construction of a support part of the suction and cover cap.

FIG. 8 illustrates a back view of the support part 46 welded to the cover plate 47. The catch basin 49 forms thereby a component of the channel system connected to the suction port 45 just as the chambers 401, the oval recess 464 for the sieve filter 48. The catch basin 49 is preferably disposed in the middle relative to the rubber insert cap positions. The pressure compensation channels 403 of the suction and cover SC cap 4 are also connected to each other to form a pressure compensation channel system through a branch-channel-like trough 465, inserted into the support part 46, in order to be able to distribute the air from the ventilation valve 55 through the air hose 53 and an air channel 430 of the ventilation port 43 uniformly onto the pressure compensation channels 403 of the suction and cover SC cap 4. As described in connection with the channel system for the suction port 45, the channel system of the ventilation port 43 is also closed by welding the cover plate 47 to the support part 46.

After the description of the detailed construction of the suction and cover SC cap 4, the functioning of the suction and cover SC cap 4 is as follows:

The suction and cover SC cap 4 is pressed with an opened ventilation valve 55 to the ink jet print unit 8 for the cleaning of the nozzle ejection openings of the ink jet print heads 80, for example, for filling, flushing, and cleaning the ink jet print heads 80. The docking of the suction and cover SC cap 4 is required while the ventilation valve 55 is opened because otherwise the air would be pressed into the nozzle ejection openings during putting on the suction and cover SC cap 4 based on the generated press-on pressure. A pressing of air into the nozzle ejection opening would result in a destruction of the ink meniscus in the nozzle ejection openings. Air streaming into the nozzle ejection openings leads to a failure of the ink jet print device 1. The control of the ventilation valve 55 is performed in this context by the control device in the ink jet print device 1. The control device is constructed in general in a conventional manner.

The ventilation valve is closed after the suction and cover SC cap 4 has been docked at the ink jet print unit 8 and the pumping process is initiated by a reversal of the rotation direction of the cam disk 20. The ink is suctioned in this context with the aid of a negative pressure, generated by the closing of the ventilation valve 55, from the nozzle ejection openings of the ink jet print heads 80. The ink exiting from the nozzle ejection openings is initially received by the liner 42. If the fluid-absorbing liner is saturated with the ink, then the remaining ink passes via the second passage opening 416 of the rubber insert cap 41, the suction channel 401, and the sieve filter 48 into the catch basin 49, and then flows via the discharge port 450 of the suction port 45 as well as the hose 52 into the discharge container 54.

If the ink jet print heads 80 are sufficiently flushed and cleaned and are subsequently filled, then the excessive ink remaining in the suction openings 40 forming hollow spaces 40 still has to be suctioned. This is required for the reason because otherwise the ink, remaining and possibly dried in the hollow spaces or suction openings 40 or, respectively, the rubber insert caps 41, would again deposit at the nozzle ejection face 800 of the ink jet print unit and would clog same upon renewed application of the suction and cover SC cap 4 to the ink jet print unit 8. In addition to suctioning the excessive ink from the hollow spaces or suction openings 40 of the suction and cover SC cap 4, the nozzle ejection face 800 of the ink-jet print unit 8 is regularly wiped after each flushing, cleaning, and filling process when the printer carriage moves out of the service and rest region according to FIG. 1, for the case that nevertheless ink is still depositing at the nozzle ejection face 800 of the ink jet print units and such that no print image disturbances can occur.

The suctioning of the excessive ink from the suction openings or, respectively, the hollow spaces 40 of the suction and cover SC cap 4 starts with the re-opening of the ventilation valve during the pumping process. The thereby suctioned air presses the ink out of the rubber insert cap 41 and the recesses or suction openings 40. The cross ribs 413, protruding into the rubber insert cap 41, are disposed on the tub floor 412 such that the ink between the liquid-absorbing liner 42 and the rubber insert cap 41 can flow off better through the second passage opening 416. The sieve filter 48 is of capillary construction in order to prevent in addition that the air passing through renders a further emptying of the neighboring other caps impossible upon emptying an individual cap 4. The capillarity of the sieve filter 48 is generated by providing that the sieve filter 48 exhibits a very fine-mesh sieve filter structure with very small holes for a total pressure in the suction and cover SC cap 4 of for example 400 mbar, where the small holes have for example in each case a diameter of 16 micrometers. The diameter for the sieve filter holes can be from about 4 to 40 micrometers and is preferably from about 10 to 20 micrometers. If the relative pressure applied at the sieve filter 48 is for example smaller than or equal to 50 mbar, then the air is blocked at the sieve filter 48. In order to be able to influence this blocking pressure at sieve filter 48, the discharge port 450 of the suction port 45 is dimensioned such that the discharge port 450 acts as a throttle for the ink suctioned from the ink jet print heads 80. Therefore, a typical diameter of the discharge port 450 amounts to for example 8/10 of a millimeter.

The pressure at the discharge port 450 has to be at least such that a difference pressure relative to the total pressure in the suction and cover SC cap 4 is smaller than the blocking pressure for the air at the sieve filter 48 for maintaining the blocking pressure. Given the predetermined blocking pressure of 50 mbar and the total pressure in the suction and cover SC cap 4 of 500 mbar, the pressure at the discharge port 450 has to be higher than 450 mbar. Since the pressure at the discharge port 450 is substantially determined by the flow rate of the ink, the pressure at the discharge port 450 changes as a function of the ink present in the suction and cover SC cap 4. The pressure drop at the discharge port 450, associated with a decreasing flow rate, is selected just such that the difference pressure surpasses the predetermined blocking pressure for the sieve filter 48 upon a complete emptying of the hollow spaces 40 and of the rubber insert caps 41 and thereby the capillaries rip off in the sieve filter 48.

During larger print pause intervals of the ink jet print device 1, the suction and cover SC cap 4 is docked with an open ventilation valve at the ink jet print heads 80. The liner 42 saturated with the ink takes care during the print pause interval for a sufficient air humidity at the nozzle ejection openings of the ink jet print unit 8 such that an evaporation and drying of the ink is thereby prevented in the ink jet print heads 80.

Figure 9:
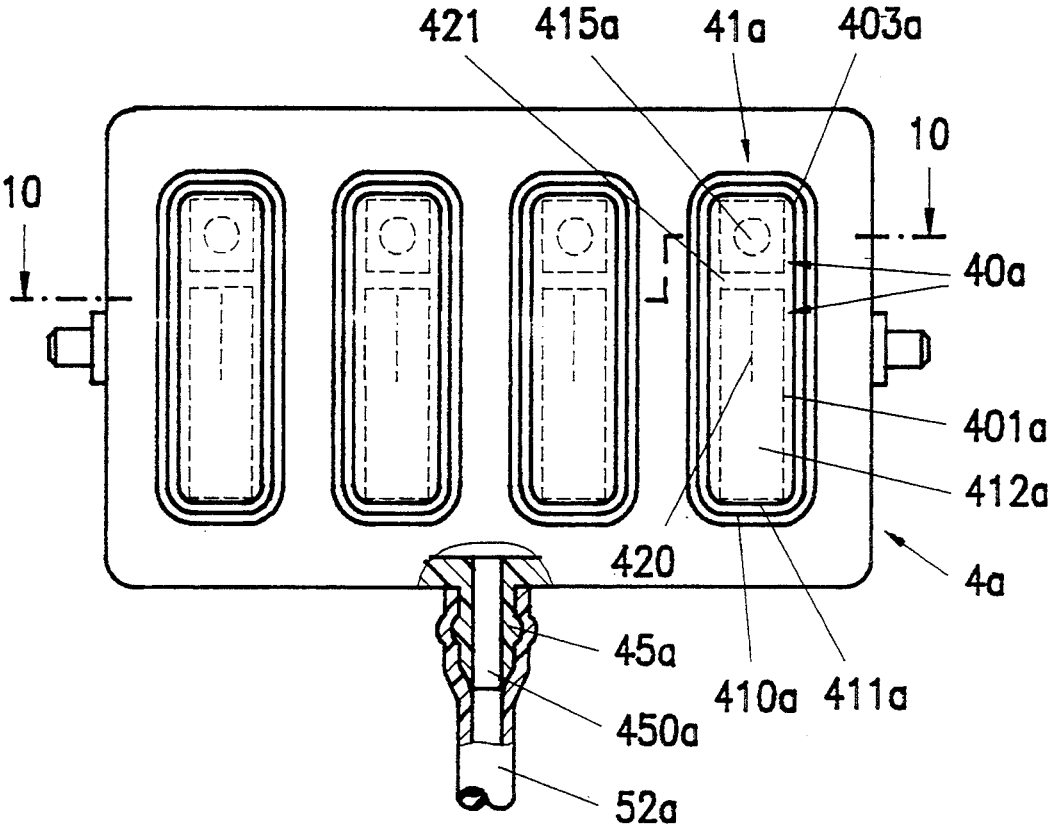
FIG. 9 is a front elevational view of a second embodiment of a suction and cover cap, corresponding to a respective detail in the upper right hand corner of FIG. 2.

The detailed construction of a second embodiment of the suction and cover SC cap 4 with four tub-shaped rubber insert caps **41*a*, integrated into a suction and cover SC cap 4*a* is shown in a top plan view of FIG. 9 for the separate suctioning of the ink from the nozzle ejection openings of the ink jet print heads 80. The suction and cover SC cap 4*a* can dispense with the controlled feeding of air via the ventilation valve and the ventilation port 43 in contrast to the suction and cover SC cap 4. Four equally sized double chambers 40*a*, disposed uniformly distributed on the suction and cover SC cap 4*a*, are characteristic for the construction of the suction and cover SC cap 4*a*, wherein the double chambers 40*a* are full face covered in each case by a tub floor 412*a* of the tub-shaped rubber insert cap 41*a*. The tub-shaped rubber insert cap 41*a* exhibits a sealing lip 410*a*, which surrounds a tub opening 411*a* of the rubber insert cap 41*a* and is pressed against the ink jet print unit 8 during the docking of the suction and cover SC cap 4*a*, and which thereby hermetically seals the nozzle ejection openings of the ink jet print heads 80. A liquid-absorbing liner 42*a* is placed in the tub-shaped rubber insert cap 41*a* through the tub opening 411*a* as occurred in connection with the suction and cover SC cap 4. The double chamber 40*a* comprises an ink chamber 401*a* and a pressure compensation chamber 403*a*. The ink chamber 401*a* is connected to a discharge port 450*a* of a suction port 45*a* through a channel system disposed in the suction and cover SC cap 4*a*. A hose 52*a* is again put on the suction port 54*a*, where the hose 52*a* transports the ink suctioned from the suction and cover SC cap 4*a* to the discharge container 54. A slot valve 420 is disposed in the tub floor 412*a* so that the ink suctioned from the ink jet print heads 80 can also pass from the tub-shaped rubber insert cap 41*a* into the ink chamber 401*a*. The slot valve 420 is realized for example by having single or multiple cuts made into the tub floor 412*a* formed as a membrane sheeting. If the suction and cover SC cap 4*a* is docked at the ink jet print unit 8 and if in the following ink is suctioned from the nozzle ejection openings of the ink jet print heads 80, then after the liner 42***a* is saturated with ink, the ink passes via the slot valve 420, opening in the suction direction, into the ink chamber 401*a* and from there through the discharge port 450*a* of the suction port 45*a* into the discharge container 54. A flowback of the ink, once having passed the slot valve 420, is no longer possible because the tabs of the slot valve 420 are prevented from flapping open in a direction opposite to the suction direction through the liner 42*a*. It is thereby prevented that undesirable color mixtures occur in the region of the tub-shaped rubber insert cap 41*a* and, consequently, that print image disturbances occur during the subsequent printing process.

The pressure compensation chamber 403*a*, which is separated by an intermediate wall 421 from the ink chamber 401*a*, is connected to the rubber insert cap 41*a* through a passage opening 415*a* recessed into the tub floor 412*a*. An air overpressure, generated during the docking of the suction and cover SC cap 4*a* at the ink jet print unit 8, is balanced through the passage opening 415*a* such that the meniscus, generated through the capillary constructed ink jet print heads 80, is maintained at the nozzle ejection openings.

Figure 10:
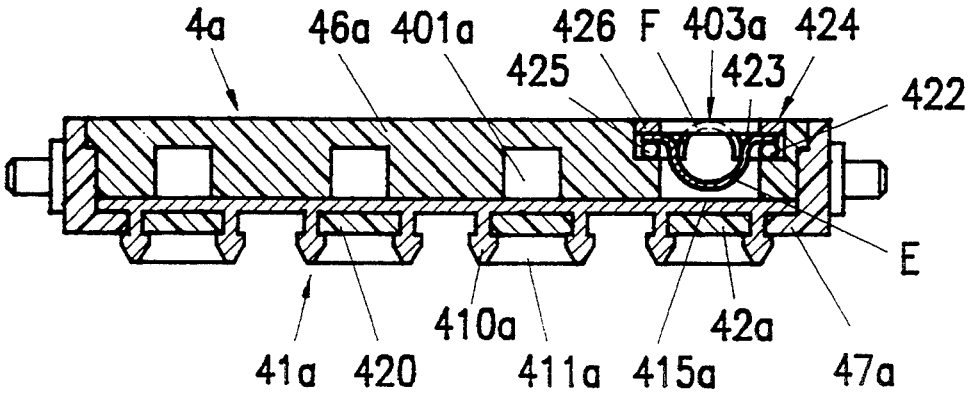
FIG. 10 is a horizontal cross-sectional view of the suction and cover cap according to FIG. 9 along section line 10—10.

FIG. 10 illustrates a section through the suction and cover SC cap 4*a* according to FIG. 9 along a section line 10—10. The suction and cover SC cap 4*a* is constructed according to FIG. 10 from the support part 46*a* and a covering 47*a*. The ink chamber 401*a* and the pressure balance chamber 403*a* are placed into the support part 46*a*. The pressure compensation chamber 403*a* completely penetrates the support part 46*a* while the ink chamber 401*a* is formed like a pocket hole. The pressure compensation chamber 403*a* is in part bored open on the side of the suction and cover SC cap 4*a* disposed opposite to the sealing lips 410*a*, whereby a stepping stage level structure 422 is generated. A hollow film bubble 423 is clamped with the aid of a clamping device 424 in this stepping structure 422, wherein the film bubble 423 operates as a pressure compensation membrane. The clamping device 424 comprises in this case an O-shaped ring 425 disposed in the stepping structure 422, where the film bubble 423 is clamped with the aid of a punched disk 426 on the O-shaped ring 425. The film bubble 423, acting as a pressure compensation membrane, reacts to the changing air pressure conditions in the suction and cover SC cap 4*a* by increasing or, respectively, decreasing the volume in the suction and cover SC cap 4*a*. If the suction and cover SC cap 4*a* is for example docked to the ink jet print unit 8, then an overpressure is generated in the suction and cover SC cap 4*a* through which the film bubble 423, compensating the overpressure, passes from one state E into a state F. The adaptation of the film bubble 423 to the respective pressure conditions in the suction and cover SC cap 4*a* operates also in cases, where the suction and cover SC cap 4*a* is subjected to variations in temperature. In addition, the film bubble 423 is produced of a non-diffusing or, respectively, weakly diffusing material such that the nozzle ejection openings of the ink jet print heads 80 are in a most effective way protected against drying out, while the ink jet print device 1 is not in operation and the suction and cover SC cap 4*a* is docked at the ink jet print unit 8.

In addition, FIG. 10 shows how the tub-shaped rubber insert cap 41*a* is disposed above the ink chambers 401*a* recessed into the support part 46*a* and above the pressure compensation chamber 403*a* and thereby the tub-shaped rubber insert cap 41*a* is clamped between the support part 46*a* and the covering 47*a*. The covering 47*a* is for this purpose bored open in the periphery of the tub opening 411*a* of the rubber insert cap 41*a* and the suction and cover SC 4 is put on over the support part 46*a* and is welded to the support part 46*a*.

It will be understood that each of the elements described above, or two or more together, may also find a useful application in other types of suction and covering devices differing from the types described above.

While the invention has been illustrated and described as embodied in the context of a suction and covering device for suctioning ink from ink print heads of an ink jet print unit and for sealing the ink jet print heads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel coordinated to and connected to the rubber insert cap for furnishing a pressure compensation in the rubber insert cap;

a suction channel connected to the rubber insert cap for allowing a withdrawal of ink;

a pressure compensation device connected to the pressure compensation channel of the rubber insert cap;

a common withdrawal channel connected to the suction channel;

a suction device connected to the common withdrawal channel; and a slot valve device including an elastic member having a slot therein and coordinated to the suction channel.

2. The suction and covering device according to claim 1, further comprising:

a common ventilation channel disposed at and coupled to the pressure compensation channel; and a controllable closure furnished at the common ventilation channel, wherein the controllable closure regulates a feeding of air as required depending on the operating position of the suction and covering device.

3. The suction and covering device according to claim 1, further comprising:

a common pressure compensation chamber for the pressure compensation channel; and a compensation membrane for closing the pressure compensation chamber relative to the ambient air, wherein the common pressure compensation chamber and the compensation membrane form a pressure compensation device as a closed system relative to the ambient air.

4. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel connected to the rubber insert cap for furnishing a pressure compensation in the rubber insert cap;

a suction channel connected to the rubber insert cap for allowing a withdrawal of ink;

a pressure compensation device connected to the pressure compensation channel of the rubber insert cap;

a common withdrawal channel connected to the suction channel;

a suction device connected to the common withdrawal channel;

a slot valve device disposed at the suction channel for assuring a controlled withdrawal of ink from the rubber insert cap; and a capillary filter disposed in the suction channel and associated with the the slot valve device, a suction pressure acting at the withdrawal channel being selected such that the capillary filter is overcome by inflowing air at ambient pressure only when the suction channel no longer contains ink upon emptying of the suction channel.

5. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel connected to the rubber insert cap for furnishing a pressure compensation in the rubber insert cap;

a suction channel connected to the rubber insert cap for allowing a withdrawal of ink;

a pressure compensation device connected to the pressure compensation channel of the rubber insert cap;

a common withdrawal channel connected to the suction channel;

a suction device connected to the common withdrawal channel;

a slot valve device disposed at the suction channel for assuring a controlled withdrawal of ink from the rubber insert cap;

a capillary filter disposed in the suction channel and associated with the valve device, a suction pressure acting at the withdrawal channel being selected such that the capillary filter is overcome by inflowing air at ambient pressure only when the suction channel no longer contains ink upon emptying of the suction channel;

a sieve with capillary openings furnished at the capillary filter; and a hydraulic throttle coordinated to and associated with the withdrawal channel, the hydraulic throttle being dimensioned such that a pressure drop through the flowing ink in the throttle is such that relative to the applied suction pressure, a difference in a pressure of the ink is smaller than a capillary pressure formed at a border face between ambient air and the sieve.

6. A suction and covering device for suctioning ink from an ink jet print head of an ink jet print unit and for covering the ink jet print head, said suction and covering device comprising:

an elastic rubber insert cap adjacent to be resting at the ink jet print head;

a pressure compensation channel coordinated to and connected to the rubber insert cap for furnishing a pressure compensation in the rubber insert cap;

a suction channel coordinated to and connected to the rubber insert cap for allowing a withdrawal of ink;

a pressure compensation device coupled and connected to the pressure compensation channel of the rubber insert cap;

a common withdrawal channel connected to the suction channel;

a suction device connected to the common withdrawal channel;

a slot valve device disposed at the suction channel for assuring a controlled withdrawal of ink from the rubber insert cap; and a one-way directional valve disposed in the valve device and coordinated to the suction channel such that the one-way directional valve opens in a suction direction of the ink and closes in a direction opposite to the suction direction of the ink.

7. The suction and covering device according to claim 1, further comprising a liner of a fluid-absorbing material disposed in the rubber insert cap.

8. The suction and covering device according to claim 1, wherein the rubber insert cap has a tub shape.

9. The suction and covering device according to claim 1, further comprising an elastically formed sealing lip surrounding a tub-shaped floor of the rubber insert cap so as to hermetically seal the ink jet print head upon pressing-on of the rubber insert cap onto the ink jet print unit.

10. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel connected to the rubber insert cap for furnishing a pressure compensation in the rubber insert cap;

a suction channel connected to the rubber insert cap for allowing a withdrawal of ink;

a pressure compensation device connected to the pressure compensation channel of the rubber insert cap;

a common withdrawal channel connected to the suction channel;

a suction device connected to the common withdrawal channel;

a slot valve device disposed at the suction channel for assuring a controlled withdrawal of ink from the rubber insert cap;

an elastically formed sealing lip surrounding a tub-shaped floor of the rubber insert cap to hermetically seal the ink jet print head upon pressing-on of the rubber insert cap onto the ink jet print unit; and a web included in the elastically formed sealing lip surrounding the tub floor of the rubber insert cap, the web being constructed like lamellas based on cross ribs whereby the elastically formed sealing lip limits a rubber insert cap opening, wherein the elastically formed sealing lip is disposed on the web.

11. The suction and covering device according to claim 10, wherein:

the elastically formed sealing lip provides a lock stop for the fluid-absorbing liner, and the elastically formed sealing lip is constructed for securing the fluid-absorbing liner disposed in the rubber insert cap against falling out.

12. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel coordinated to and connected to the rubber insert cap for furnishing a pressure compensation in the rubber insert cap;

a suction channel coordinated to and connected to the rubber insert cap for allowing a withdrawal of ink;

a pressure compensation device coupled and connected to the pressure compensation channel of the rubber insert cap;

a common withdrawal channel connected to the suction channel;

a suction device connected to the common withdrawal channel;

a slot valve device disposed at the suction channel for assuring a controlled withdrawal of ink from the rubber insert cap;

an elastically formed sealing lip surrounding a tub-shaped floor of the rubber insert cap to hermetically seal the ink jet print head upon pressing-on of the rubber insert cap onto the ink jet print unit; and a burl-shaped extension disposed at a floor of the rubber insert cap, the burl-shaped extension serving for an attachment of the rubber insert cap in a single form part.

13. The suction and covering device according to claim 12, wherein the burl-shaped extension is adapted to receive one of the pressure compensation channel and the suction channel.

14. The suction and covering device according to claim 13, wherein the burl-shaped extension receives the suction channel and includes a funnel-shaped port which rests in an assembled state of the rubber insert cap at the capillary filter.

15. The suction and covering device according to claim 1, further comprising:

a second elastic rubber insert cap provided at a second ink jet print head, the number of rubber insert caps corresponding to the number of ink jet print heads;

a second pressure compensation channel connected to the second rubber insert cap for furnishing a pressure compensation in the second rubber insert cap, wherein the pressure compensation device is connected to the second pressure compensation channel of the second rubber insert cap; and a second suction channel connected to the second rubber insert cap for allowing a withdrawal of ink, the common withdrawal channel being connected to the suction channel.

16. A suction and covering device for suctioning ink from an ink jet print head of an ink jet print unit and for covering the ink jet print head, said suction and covering device comprising:

an elastic rubber insert cap adjacent to the ink jet print head;

a pressure compensation channel connected to the rubber insert cap for furnishing a pressure compensation in the rubber insert cap;

a suction channel connected to the rubber insert cap for allowing a withdrawal of ink;

a pressure compensation device connected to the pressure compensation channel of the rubber insert cap;

a common withdrawal channel connected to the suction channel;

a suction device connected to the common withdrawal channel wherein a number of rubber cap inserts equals a number of ink jet print heads provided;

a slot valve device disposed at the suction channel for assuring a controlled withdrawal of ink from the rubber insert cap;

a tub-shaped second elastic rubber insert cap provided at a second ink jet print head, the number of rubber insert caps corresponds to the number of ink jet print heads;

a second pressure compensation channel connected to the second rubber insert cap for furnishing a pressure compensation in the second rubber insert cap, wherein the pressure compensation device is connected to the second pressure compensation channel of the second rubber insert cap;

a second suction channel connected to the second rubber insert cap for allowing a withdrawal of ink, the common withdrawal channel being connected to the suction channel;

a second liner of a fluid-absorbing material disposed in the second rubber insert cap;

a second elastically formed sealing lip surrounding a second tub-shaped floor of the second rubber insert cap, the second elastically formed sealing lip hermetically sealing the second ink jet print head upon pressing-on of the second rubber insert cap onto the ink jet print unit;

a second web included in the second elastically formed sealing lip surrounding the second tub floor of the second rubber insert cap, the second web being constructed like lamellas based on cross ribs, the second elastically formed sealing lip limiting a rubber insert cap opening, and the second sealing lip being disposed on the second web wherein the second elastically formed sealing lip provides a second lock stop for the second fluid-absorbing liner, and wherein the second elastically formed sealing lip is constructed for securing the second fluid-absorbing liner disposed in the second rubber insert cap against falling out; and a second burl-shaped extension disposed at the second rubber insert cap, wherein the second burl-shaped extension is disposed at a second floor of the second rubber insert cap, and wherein the second burl-shaped extension serves for an attachment of the second rubber insert cap in the single form part, wherein the second burl-shaped extension, disposed at the floor of the rubber insert cap, receives one of the pressure compensation channel and the suction channel.

17. The suction and covering device according to claim 16, wherein:

the second burl-shaped extension receives the suction channel;

the second burl-shaped extension includes a second funnel-shaped port; and the second funnel-shaped port rests in an assembled state of the second rubber insert cap at the capillary filter.

18. A suction and covering device for suctioning ink from ink jet print heads of an ink jet print device and for covering the ink jet print heads, said suction and covering device comprising:

a) elastic rubber insert caps adjacent to the ink jet print heads, wherein the number of rubber insert caps equals a number of ink jet print heads provided;

b) a pressure compensation channel associated with each of the rubber insert caps and coupled to a pressure compensation device for pressure compensation in the rubber insert caps;

c) a suction channel associated with each of the rubber insert cams for withdrawal of ink, the suction channels joining in a common withdrawal channel which is in connection with a suction device; and d) an elastic member having a slot therein and coordinated to each suction channel.

19. A suction and covering device for suctioning ink from ink jet print heads of an ink jet print device and for covering the ink jet print heads as set forth in claim 18, further comprising a valve device coordinated to each suction channel for a controlled withdrawal of ink from each cap, wherein:

the pressure compensation device exhibits a common ventilation channel coupled with the pressure compensation channels, the common ventilation channel has a controllable closure for the feeding of air as required depending on the operating position of the suction and covering device;

the pressure compensation device is formed as a closed system relative to the ambient air, with a common pressure compensation chamber for the pressure compensation channels and a compensation membrane, closing the pressure compensation chamber relative to the ambient air;

the valve device, coordinated to the suction channels, exhibits a capillary filter disposed in the suction channels, a suction pressure acting at the withdrawal channel is selected such that, upon emptying the suction channels, the capillary filter is only then overcome by the inflowing ambient air through the suction channels when all suction channels no longer contain any ink;

the capillary filter is a sieve with capillary openings; and a hydraulic throttle is coordinated to the withdrawal channel, the hydraulic throttle being dimensioned such that a pressure drop through the flowing ink in the throttle is at least so large that a difference in pressure relative to the applied suction pressure is smaller than a capillary blocking pressure at the border face between ambient air and the sieve.

20. A method of a covering and suctioning of an ink jet print unit comprising the steps of:

positioning a cleaning and sealing station in an overshoot region of an ink jet print head;

pressing an elastic rubber insert cap, attached to the cleaning and sealing station, against the face of the ink jet print head such that an ink jet nozzle of the ink jet print head is completely covered;

furnishing a pressure compensation in the rubber inset cap through a pressure compensation channel connected to the rubber insert cap;

withdrawing ink through a suction channel connected to the rubber insert cap;

setting the pressure in the pressure compensation channel with a pressure compensation device, connected to the pressure compensation channel of the rubber insert cap;

suctioning the ink through the suction channel and through a common withdrawal channel connected to the suction channel; and regulating the withdrawal of ink from the rubber insert cap with a device including an elastic member having a slot therein and coordinated to the suction channel.

21. A method of covering and suctioning of an ink jet print unit comprising the steps of:

positioning a cleaning and sealing station in an overshoot region of an ink jet print head;

pressing an elastic rubber insert cap, attached to the cleaning and sealing station, against the face of the ink jet print head such that an ink jet nozzle of the ink jet print head is completely covered;

furnishing through a pressure compensation channel, connected to the rubber insert cap, a pressure compensation in the rubber insert cap;

withdrawing ink through a suction channel connected to the rubber insert cap;

setting the pressure in the pressure compensation channel with a pressure compensation device, connected to the pressure compensation channel of the rubber insert cap;

suctioning the ink through the suction channel and through a common withdrawal channel connected to the suction channel;

regulating the withdrawal of ink from the rubber insert cap with a valve device disposed in the suction channel, said valve device including a capillary filter;

regulating a feeding of air into a common ventilation channel disposed at and coupled to the pressure compensation channel, depending on the operating position of the suction and cover device;

closing the pressure compensation chamber relative to the ambient air via a compensation membrane;

selecting the suction pressure acting on the withdrawal channel such that, the capillary filter is overcome by inflowing air at ambient pressure only when the suction channel no longer contains ink upon emptying of the suction channel; and dropping a pressure in the flowing ink by a hydraulic throttle disposed in the withdrawal channel such that a pressure drop through the flowing ink in the throttle is such that, relative to the applied suction pressure, a difference in a pressure of the ink is smaller than a capillary blocking pressure formed at a border face between ambient air and the capillary filter.

* * * * *

UNITED STATES PATENT AND TRADEMARK OFFICE

CERTIFICATE OF CORRECTION

PATENT NO. : 5,426,456

DATED : 06/20/95

INVENTOR(S) : Peter Kuelzer et al.

It is certified that error appears in the above-indentified patent and that said Letters Patent is hereby corrected as shown below:

In Column 21, claim 4, line 25, delete "the" (second occurrence).

In Column 25, claim 19, line 59, change "the" to --a--.

Signed and Sealed this

Thirteenth Day of February, 1996

*Attest:*

Bruce Lehman

BRUCE LEHMAN

*Attesting Officer*

*Commissioner of Patents and Trademarks*